United States Patent [19]

Bennett et al.

[11] 4,057,398

[45] Nov. 8, 1977

[54] PROCESS FOR REDUCING THE FUSION POINT OF COAL ASH

[75] Inventors: Robert P. Bennett, Bridgewater; Ira Kukin, West Orange, both of N.J.

[73] Assignee: Apollo Chemical Corporation, Whippany, N.J.

[21] Appl. No.: 660,838

[22] Filed: Feb. 24, 1976

[51] Int. Cl.[2] ..... C10L 9/00; C10L 10/00

[52] U.S. Cl. ..... 44/4; 110/165 R; 122/379

[58] Field of Search ..... 44/1 A, 4, 5; 110/165 R; 122/379

[56] References Cited

U.S. PATENT DOCUMENTS

| | | | |
|---|---|---|---|
| 1,183,445 | 5/1916 | Foxwell | 44/44 |
| 1,618,465 | 2/1927 | Nybakker | 44/4 |
| 3,332,755 | 7/1967 | Kukin | 44/4 |
| 3,738,819 | 6/1973 | Milner et al. | 44/4 |

*Primary Examiner*—Carl F. Dees

*Attorney, Agent, or Firm*—James & Franklin

[57] ABSTRACT

The fusion point of coal ash in a boiler is reduced by introducing a boron-containing compound into a boiler containing coal ash and mixing the compound and the coal ash. Preferably the compound is introduced into the furnace box of the boiler as an intimate mixture of pulverized or crushed coal and the compound, the coal being intimately mixed with the compound prior to introduction of the mixture into the furnace box.

8 Claims, 2 Drawing Figures

PROCESS FOR REDUCING THE FUSION POINT OF COAL ASH

BACKGROUND OF THE INVENTION

There exist manifold situations in which a process for reducing the fusion point of coal ash could be gainfully employed. A representative sampling of such situations is listed and discussed below.

1. Daily operation of wet bottom boilers.

In wet bottom boilers such as cyclone and slag tap furnaces, the ash particles resulting from the burning of coal are permitted to collect in the bottom of the furnace box from which the ash is continually removed as a molten liquid. If, for any reason, the molten coal ash or slag does not run, it can very quickly close over the slag drain openings and result in shut-down of the entire furnace. Accordingly, a wet bottom boiler is usually designed with a particular type of coal in mind as the sole fuel for the design, the working assumption being that such coal will be of uniform ash content and that the slag will be of uniform viscosity and fusion point.

Unfortunately, the working assumption is but a working assumption. The ash content of coals varies widely not only in coal from different parts of the world, but even in different seams within the same region, or even in different parts of the same mine. For instance, the bulk of the bituminous coal used for power generation in the United States has an ash content generally within the range of 6–20%, but some such coals have an ash content as high as 30%. Furthermore, the temperature within the furnace box of a slag tap furnace will vary with the operating level of the furnance. For example, during low load operation, even a coal with a slag of medium fusion point may not be suitable for slag tapping since the furnace box temperature may not be sufficiently high to obtain the degree of fluidity necessary for tapping.

Numerous attempts have been made to determine relationships so that one can calculate the slagging tendencies (that is, the ash fusion points and ash viscosities) of a coal ash from its chemical composition. The composition of coal ash is customarily determined by a chemical analysis of the residue which is produced by burning a sample of coal at a slow rate and at a moderate temperature (732° C) under oxidizing conditions in a laboratory furnace. Such analysis reveals that coal ash is composed chiefly of compounds of silicon, aluminum, iron and calcium, with smaller amounts of magnesium, titanium, sodium and potassium. However attempts to calculate parameters such as the fusion point and viscosity of the coal ash from a chemical analysis of the coal ash have left much to be desired, and none of the particular ratios utilized for this purpose (such as the silica ratio, the base-to-acid ratio, etc.) seems to be satisfactory under all conditions.

As knowledge of the factors affecting ash deposition has increased, guidelines have been established to arrive at suitable equipment designs for various fuels. One such guideline is called a "fouling index", which uses a total alkali content in the coal as a criterion. This guideline is primarily useful for predicting fouling in the superheater area resulting from flue gas fly ash, and is unfortunately not of particular value in the prediction or correction of slag tap problems resulting from fusion point or viscosity problems with coal ash. While various studies regarding the correction of such slag tap problems have indicated possible techniques for correction of such slag tap problems, such techniques tend to be effective only with particular ranges of coal composition, create secondary furnace problems of their own, and/or are simply not economically feasible. For example, use of an inexpensive salt such as sodium sulfate as an additive to the coal to be burned presents the danger of hydrogen sulfide generation under certain conditions. The use of soda ash (sodium carbonate) or caustic (sodium hydroxide) is effective only at additive levels which are so high that the amount of sodium introduced presents corrosion problems.

Thus, the need remains not only for a method of lowering the ash fusion point and ash viscosity of coals of known slagging characteristics (so that such coals may be utilized in slag furnaces designed for operation in connection with coals exhibiting better slagging characteristics), but also for a method of modifying such slagging characteristics "on the fly" in response to hour-by-hour variations in the coal composition and operating levels of the slag furnace.

2. Freeing of clogged slag drains in wet bottom boilers.

For a variety of reasons (including fluctuations in the coal composition being fed to the furnace and/or in the operating level of the furnace), high fusion point coal ash may unexpectedly solidify within and close the slag drain openings of a wet bottom boiler. This can require a temporary shutting down of the furnace to permit a re-opening of the slag drain openings. A clearly more acceptable procedure would be to reduce the fusion point of the clogging solidified coal ash so that it again becomes molten and flows out the slag drain openings.

3. Shutdown of wet bottom boilers.

When a wet bottom cyclone furnace is being taken down for a planned or emergency outage or shutdown, the normally molten slag solidifies in the cyclones as the boiler cools. This results in expensive and time consuming cleaning operations to remove the solidified slag from the cyclones before the unit can be restarted. Any means of reducing the amount of slag during the shutdown operation would obviously reduce or even eliminate the hours normally spent on cleaning the cyclones. A method of lowering the ash fusion point would significantly reduce the amount of slag left in the cyclones. Three reasons for this are proposed. First, it would lower the viscosity of the molten slag already present, allowing it to flow more rapidly out of the cyclone; second, while the furnace is still at operating temperatures, any solidified slag present would tend to soften and become fluid; and, third, after the fuel supply has been cut off and the unit starts to cool, the treated slag having a lower fusion point will remain molten and fluid, and thus able to drain for a longer period of time than would be the case for untreated slag.

4. Improved insulation of dry bottom boilers.

During the operation of a furnace some heat is lost by absorption and conductance through the furnace walls. If this loss is excessive, then the exit gas temperature from the furnace falls below the design temperature, steam temperatures drop, and the overall efficiency of the unit decreases. Slag on the furnace walls acts as a thermal insulator and can reduce this heat loss through the furnace walls. In wet bottom coal fired units, molten slag is invariably present during operation and the walls of the furnace are usually at least partially coated with slag. In a dry bottom furnace where, by choice, a coal with a high fusion point ash is burned, the ash is dry and does not tend to stick to and insulate the walls. Use of a coal with a lower ash fusion point is not possible here simply because the furnace is not designed to handle large amounts of molten slag. However, intermittent use of an additive which would lower the fusion point of a small portion of theash and cause localized ash build-up on the furnace walls the ash insulate the furnace walls.

5. Slag removal from walls of wet and dry bottom boilers.

During the normal operation of wet bottom boilers and during the operation of dry bottom boilers as indicated immediately above, excessive accumulations of solidified coal ash can form on the interior walls of a boiler, where they are difficult to remove. These accumulations are frequently referred to as "eyebrows" and can exceed the size of a grand piano. Lowering the fusion point of such eyebrows would allow them to drop off the boiler wall for easy collection and removal.

Accordingly, it is an object of the present invention to provide a method for reducing the fusion point of coal ash in a boiler.

It is another object to provide such a method which can be used to improve the slagging characteristics "on the fly" in response to momentary fluctuation in the coal composition and/or operating level of a wet bottom boiler.

It is a further object to provide such a method which can be used to open slag-clogged drain openings of a wet bottom boiler.

It is also an object to provide such a method which can be used to facilitate or eliminate the need for cleaning of a wet bottom boiler after its shut-down.

Another object is to provide such a process which can be used to improve the effective wall insulation of a dry bottom boiler.

A further object is to provide such a process which can be used to facilitate slag removal from the walls of both wet and dry bottom boilers.

A final object is to provide such a method which is economically feasible and which does not compound other problems associated with boilers.

SUMMARY OF THE INVENTION

It has now been found that the fusion point of coal ash in a boiler may be reduced by introducing a boron-containing compound into a boiler containing coal ash and mixing the compound with the coal ash. The boron-containing compound may be introduced into the boiler either by itself (for example, by a simple aspiration technique) or as an intimate mixture of pulverized coal and the compound. In the latter case, the coal is preferably crushed or even pulverized and intimately mixed with the compound prior to introduction of the mixture into the furnace box of the boiler. Generally, at least 0.5 kilograms, and preferably about 0.5–50 kilograms, of the boron-containing compound are introduced per metric ton of coal introduced into the boiler. In some instances, the boron-containing compound preferably also contains sodium.

DETAILED DESCRIPTION OF THE PREFERRED EMBODIMENTS

Figure 1:
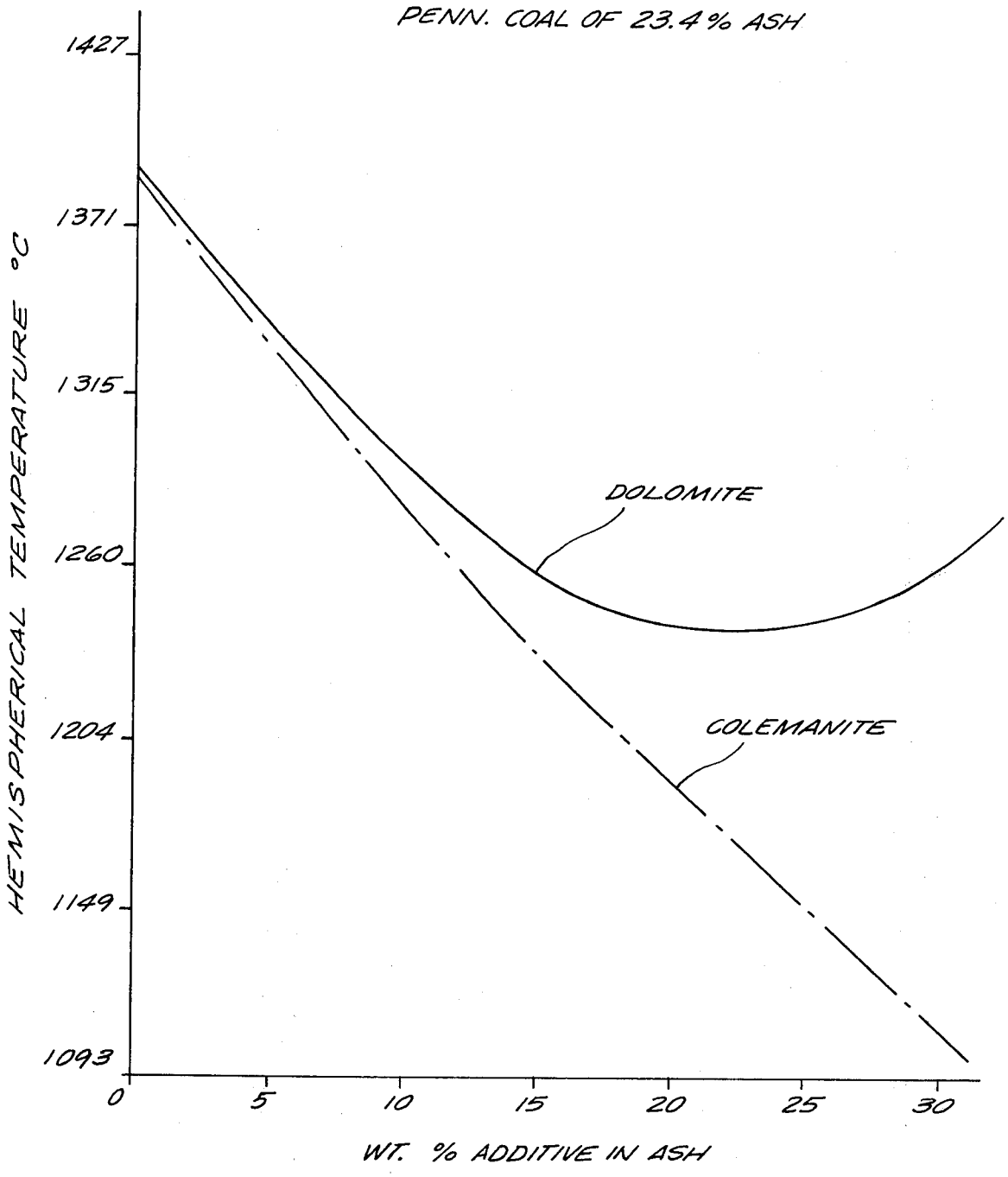
FIG. 1 is a graph illustrating the effect of varying amounts of additives on the coal ash fusion temperature of a Pennsylvania coal having an ash content of 23.4%.

According to the present invention, the fusion point of coal ash in a boiler may be reduced by as much as 100°–150° C (and even up to 400° C in some instances) by introducing a boron-containing compound into the boiler and mixing it with the coal ash.

Representative of the boron-containing compounds which are effective in the present invention are the various borates, such as ammonium, lithium, magnesium, potassium and sodium borate, and the naturally existing boron-containing minerals, of which the following is only a representative list:

| | |
|---|---|
| Colemanite Ore | $Ca_2B_6O_{11} . 5H_2O$ |
| Ulexite ore | $NaCaB_5O_9 . 8H_2O$ |
| Tincal | $Na_2B_4O_7 . 10H_2O$ |
| Kernite | $Na_2B_4O_7 . 4H_2O$ |
| Ammonioborite | $(NH_4)_3B_{10}O_{16} . 5H_2O$ |
| Axinite | $H(Fe,Mn)Ca_2Al_2BSi_4O_{16}$ |
| Boracite | $6MgO . MgCl_2 . 8B_2O_3$ |
| Borax | $Na_2O . 2B_2O_3 . 10H_2O$ |
| Cappelenite | Borosilicate of Y and Ba |
| Danburite | $CaO . B_2O_3 . 2SiO_2$ |
| Datolite | $2CaO . B_2O_3 . 2SiO_2 . H_2O$ |
| Dumortierite | $8Al_2O_3 . B_2O_3\ 6SiO_2 . H_2O$ |
| Fersmite | Ca niobate of a $B_2O_6$ group |
| Hambergite | $Be_2(OH)BO_3$ infusible |
| Homilite | $(Ca,Fe)_3(BO)_2(SiO_4)_2$ |
| Ludwigite | $3MgO . B_2O_3 . FeO . Fe_2O_3$ |
| Manandonite | $H_{24}Li_4Al_{14}B_4Si_6O_{53}$ |
| Priceite | $5CaO . 6B_2O_3 . 9H_2O$ |
| Sassolite | $B_2O_3 . 3H_2O$ |
| Sussexite | $HRBO_3$ (R = Mn, Zn, Mg) |
| Warwickite | $(Mg,Fe)_3\ TiB_2O_8$ |
| Boron Oxide | $B_2O_3$ |
| Ammonium Borate | $NH_4HB_4O_7 . 3H_2O$ |
| Boric Acid | $H_3BO_3$ |
| Calcium Metaborate | $Ca(BO_2)_2 . 2H_2O$ |
| Lithium Metaborate | $LiBO_2$ |
| Lithium Tetraborate | $LiB_4O_7 . 5H_2O$ |
| Magnesium Metaborate | $Mg(BO_2)_2 . 8H_2O$ |
| Potassium Metaborate | $K_2B_2O_4$ |
| Potassium Tetraborate | $K_2B_4O_7 . 5H_2O$ |
| Sodium Metaborate | $NaBO_2$ |
| Sodium Metaborate | $NaBO_2 . 4H_2O$ |
| Sodium Tetraborate | $Na_2B_4O_7$ |
| Sodium Tetraborate | $Na_2B_4O_7 . 5H_2O$ |
| Sodium Tetraborate | $Na_2B_4O_7 . 10H_2O$ (Borax) |
| Sodium Perborate | $NaBO_3 . H_2O$ |

Where low levels of sodium may be tolerated without posing corrosion problems, the boron-containing compounds also containing sodium (such as ulexite) are preferably used to obtain the supplemental art-recognized effect of sodium alone in lowering the fusion point of coal ash. Conversly where sodium corrosion might pose an intolerable problem due to the composition of the coal or the susceptible nature of the materials used in the furnace box, a boron-containing compound which is essentially sodium-free (such as colemanite) will be preferred. Other considerations taken into account in selecting the particular boron-containing compound will be its cost, availability, purity, etc.

Generally at least 0.5 kilograms of the boron-containing compound are added per metric ton (1000 kilograms) of coal introduced into the boiler. When the compound is being added on a continuous basis, a low treatment concentration of about 2.5–5.0 kilograms of compound per metric ton of coal is preferred; when the compound is being added on a one-shot or emergency basis, a higher treatment concentration (as high as 50 kilograms of compound per metric ton of coal) is preferred. In addition to the aforementioned nature of the addition, obviously the optimum treatment concentration will be dependent upon parameters well recognized by those skilled in the art such as the composition of the coal (e.g., ash content and composition), the slag tap furnace design parameters, and the firing condition of the furnace box. Treatment concentrations within the specified limits have been found effective to provide fusion point reductions of about 100° to 150° C for coal ash produced from a broad variety of coal compositions, and to do so without introducing secondary problems such as corrosion or the production of noxious gases. Selection of the particular boron-containing compound to be used will be influenced by the various parameters described above in connection with the quantities thereof to be used.

The boron-containing compound may be introduced into the boiler either separately from the coal being introduced into the furnace box, or as an intimate mixture of the boron-containing compound and the coal. The boron-containing compound may be added to the boiler on a continuous basis to permit the use of coal having a natural fusion point higher than that for which the boiler was originally designed, on an intermittent basis as required to compensate "the fly" for fluctuations in the composition of the coal being introduced into the furnace box or for fluctuations in the operating level of the furnace, or on an "as needed" basis to remove "eyebrows" and other slag build-up on boiler walls or to create an insulating slag build-up on dry bottom boiler walls, or on emergency basis to effect fluidization of slag which has solidified over and clogged the slag drain openings of a wet bottom boiler, or on a one shot basis prior to shut-down of a wet bottom boiler.

The boron-containing compound may be introduced into the boiler in a variety of different ways including aspiration (either with or separately from the combustion air supply) and other conventional techniques for introducing additives to the boiler. Preferably, the boron-containing compound is introduced into the furnace box of the boiler on a continuous basis, as part of the coal-feeding procedure associated with the particular slag tap furnace, as an intimate mixture of the compound and crushed or pulverized coal. The same results are achieved whether the intimate mixture is formed by mixing the compound with pulverized coal or by mixing the compound with unpulverized coal and then pulverizing the mixture.

While it is preferred that the boron-containing compound be present when the coal ash is formed, it is also effective to reduce the fusion point of coal ash when it is intimately mixed with pre-existing molten or solidified slag in the furnace. While means may be provided within the boiler to cause positive intermixing of the boron-containing compound with the pre-existing slag, the turbulent conditions generally existing in a boiler are typically adequate to provide the intimate mixing of the boron-containing compound with exposed slag surfaces. As the boron-containing compound becomes initimately mixed with the exposed surface of even a solidified slag, it is effective to fluidize that slag surface and thereby permit its intimate mixing on a progressive basis with succeeding layers of solidified slag until the entire solidified slag deposit is fluidized to a point permitting removal of the fluidized slag through the slag drain openings of the furnace box. Thus, in addition to maintaining a wet bottom furnace in running condition, the process of the present invention has been used to remove the very large "eyebrows" and other slag build-ups at various heights on both wet and dry bottom boiler walls, to clear slag taps and cyclones prior to cleaning shut-downs, to create insulating slag deposits on dry bottom boiler walls, and the like, all without deleterious effects.

While the boron-containing compound is the essential component for achieving the fusion point reduction, other conventional additives, such as dolomite, may be used in conjunction with the boron-containing compound to produce a fusion point reduction of the coal ash greater than that which would be produced by the boron-containing compound alone. For example, dolomite may be added with the boron-containing compound (either separately from the coal or as part of the intimate mixture with the coal) or separately from the boron-containing compound, the turbulent conditions of the furnace acting to provide an intimate mixture of the dolomite, the boron-containing compound and the coal ash.

Figure 2:
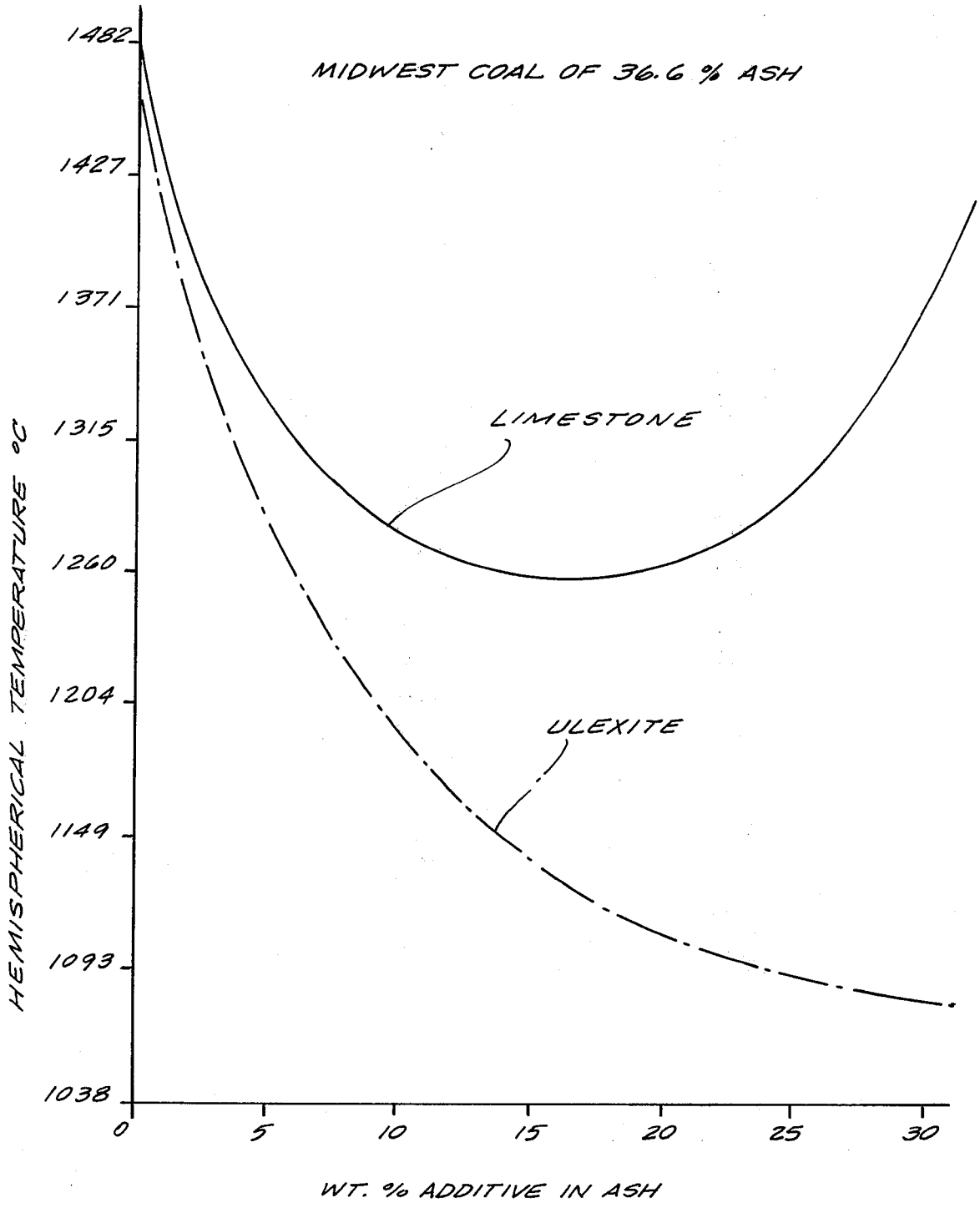
FIG. 2 is a graph illustrating the effect of varying amounts of additives on the coal ash fusion temperature of a Midwest coal having an ash content of 36.6%.

Referring now to FIGS. 1 and 2, therein illustrated is the effect on hemispherical temperature of varying concentrations of fusion point reducing additives in the coal ash. FIG. 1 illustrates the comparative effects of a boron-containing compound (colemanite) and a conventional additive (dolomite) on a Pennsylvania coal having an ash content of 23.4%.

FIG. 2 illustrates the comparative effects of a sodium — and boron-containing compound additive (ulexite) and a conventional additive (limestone) on a Midwest coal having an ash content of 36.6%. Whereas the effectiveness of the conventional additives for reducing the fusion point temperature of coal ash (e.g., dolomite and limestone) increases with higher additive concentrations up to a given concentration, above that given concentration there appears to be a negative effect, such that there occurs a lesser fusion point reduction than at lower concentrations. However, the occurrence of such a negative effect is not observed in connection with the boron-containing compounds of the present invention (e.g., colemanite and ulexite).

The efficacy of the present invention is illustrated in the following examples, wherein all parts are given on a weight basis.

EXAMPLE I

Coal samples A, G and H for use in Examples II and III were obtained, fired and their ash content analyzed by conventional techniques with the results indicated in Table I. The values for constituents are percent by weight, based on the ash in the coal. The constituents are listed as oxides and the values therefor frequently total more than 100% when reported this way because they are often actually in combined form in the coal. Analyses vary considerably even within one coal seam, so the values are at best typical.

TABLE I

| PROPERTY | SAMPLES A | G | H |
|---|---|---|---|
| % Ash | 15.7 | 12.2 | 17.0 |
| $SiO_2$ | 40.21 | 45.24 | 49.45 |
| $Al_2O_3$ | 17.78 | 20.66 | 25.19 |
| $Fe_2O_3$ | 6.06 | 19.35 | 18.62 |
| CaO | 14.27 | 20.47 | 2.00 |
| MgO | 2.67 | 1.21 | 0.86 |

TABLE I-continued

| PROPERTY | SAMPLES A | G | H |
|---|---|---|---|
| $Na_2O$ | 0.51 | 0.62 | 1.72 |

EXAMPLE II

Ash produced according to ASTM-D271 from coal Sample A was intimately mixed to a given treatment concentration (5 kilogram additive per metric ton of coal) with either a conventional additive (Samples B and C), a boron-containing additive (Sample D), a boron- and sodium-containing additive (Sample E) or an 80:20 weight mixture of a boron-containing additive and a conventional additive (Sample F). The fusion points of the ash (Sample A) and the mixtures (Sample B-F) were then determined according to ASTM-D1857 under oxidizing conditions (using an electric furnace) with the results indicated in Table II.

In terms of initial deformation temperature (i.e., the temperature at which the first rounding of the apex of the ash cone occurs), the prior art additives of Samples B and C produced a 14°–33° C reduction, while the additives of the present invention produced a 100°–127° C reduction, a minimum threefold improvement for Samples D-F. In terms of hemispherical temperature (i.e., the temperature at which the cone has fused down to a hemispherical lump at which point the height is one half the width of the base), the prior art additives produced a 56° C reduction, while the additives of the present invention produced a 139°–156° C reduction, a minimum twofold improvement. In terms of the fluid temperature (i.e., the temperature at which the fused mass has spread out in a nearly flat layer with a maximum height of 0.159 cm), the prior art additives produced a 28°–42° C reduction, while the additives of the present invention produced a 156°–169° C reduction, a minimum threefold improvement.

EXAMPLE III

The procedure of Example II was duplicated for coal Samples G and H (ash contents 12.2% and 17.0%, respectively) using additives of the present invention (ulexite and sodium borate, respectively), the results being indicated for untreated coals G and H and treated coals G′ and H′ in Table III.

TABLE II

| SAMPLE | FUSION POINT REDUCTION A (control) | B (prior art) | C (prior art) | D | E | F | |
|---|---|---|---|---|---|---|---|
| Ash Content - % | 15.7 | | | | | | |
| Ash Fusibility (° C) | | | | | | | |
| Initial Deformation | 1482 | 1449 | 1468 | 1355 | 1382 | 1360 | |
| Hemispherical Temp. | 1538 | 1482 | 1482 | 1382 | 1399 | 1377 | |
| Fluid Temp. | 1566 | 1524 | 1538 | 1397 | 1410 | 1399 | |
| Treatment Concentration | — | 5 | 5 | 5 | 5 | 5 | |
| Additive | — | Lime | Dolomite | Colemanite | Sodium borate | Ulexite + Dolomite | (80%) (20%) |

TABLE III

| SAMPLE | FUSION POINT REDUCTION G Untreated | G′ Treated | H Untreated | H′ Treated |
|---|---|---|---|---|
| Ash Content - % | 12.2 | | 17.0 | |
| Ash Fusibility (° C) | | | | |
| Initial Deformation | 1315 | 1204 | 1438 | 1360 |
| Hemispherical Temp. | 1371 | 1343 | 1482 | 1399 |
| Fluid Temp. | 1427 | 1371 | 1549 | 1432 |
| Treatment Concentration | — | 5 | — | 5 |
| Additive | — | Ulexite | — | Sodium borate |

EXAMPLE IV

A 200 megawatt B&W four cyclone boiler burning 15.5–16.4 metric tons/hour/cyclone of a Pennsylvania Basin bituminous coal was treated with an approximately 4:1 mixture by weight of ulexite and dolomite. About 80 kilograms were fed into each cyclone (over a 15 minute period) two hours before shutdown. A subsequent inspection showed the cyclones to be cleaner than they had ever been before immediately after a shutdown.

EXAMPLE V

A 280 megawatt Riley P.C. balanced draft boiler burning 109 metric tons/hour of an Eastern Kentucky bituminous coal with high fusion point ash (Initial Deformation 1516° C, softening temperature >1593° C) could not hold design temperatures due to excessive heat loss through the furnace walls. Visual inspection showed the furnace walls to be very clean and free of ash or slag deposits.

Addition of an approximately 4:1 mixture by weight of ulexite and dolomite at a rate of 5.9 kilograms/metric ton of coal consumed over a two and one quarter hour period caused a reduction of ash fusion temperature and a buildup of deposits on the furnace surfaces. Simultaneously exit gas temperatures increased and the undesirable difference in temperature between superheat and reheat was cut by 17° C. This 50% reduction of the differential between superheat and reheat improved the unit efficiency and thus lowered the generating costs per kilowatt-hour. The improved operating conditions persisted even after the addition of the additive was discontinued. The deposits on the walls sloughed off with time, and the additive was reapplied on an intermittent basis to maintain an insulating coating on the interior surfaces of the furnace.

To summarize, the present invention provides a process for lowering the fusion point of coal ash through use of a boron-containing compound. The boron-containing compound treatment is several times more effective than conventional additive treatments at the same concentration level, and may be used at higher concentration levels without encountering negative effects. It may be used with both wet-and dry-bottom boilers and provides a means for modifying the slagging characteristics "on the fly" in response to momentary fluctuations in coal composition and/or operating level of the boiler.

Now that the preferred embodiments of the present invention have been described in detail, various modifications and improvements thereon will become readily apparent to those skilled in the art. For example, it is now customary to include in the fuel for a boiler not only coal, but also a quantity of waste or refuse material of varying compositions. The fusion point of the ash from such a combination fuel may also be reduced using the process of the present invention in connection with such fuels. Accordingly, the spirit and scope of the present invention is to be limited only by the appended claims, and not by the foregoing disclosure.

We claim:

1. A method of reducing the fusion point of coal ash in a boiler comprising the steps of introducing a compound from the class consisting of borates and naturally occurring boron-containing minerals into a boiler containing coal ash and mixing said compound and said coal ash, at least 0.5 kilograms of said compound being introduced per metric ton of coal introduced into the boiler.

2. The method of claim 1 wherein said compound is introduced into the furnace box of the boiler as an intimate mixture of pulverized coal and said compound, and including the additional step of intimately mixing said compound with pulverized coal prior to introduction of the mixture into the furnace box.

3. The method of claim 1 wherein said compound is introduced into the boiler by aspiration.

4. The method of claim 1 wherein about 0.5–50 kilograms of said compound are introduced per metric ton of coal introduced into the boiler.

5. The method of claim 1 wherein said compound is sodium-containing.

6. The method of claim 2 wherein about 0.5–50 kilograms of said compound are introduced per metric ton of coal introduced into the boiler.

7. The method of claim 2 wherein said compound is sodium-containing.

8. The method of claim 7 wherein said compound is sodium-containing.

* * * * *

UNITED STATES PATENT AND TRADEMARK OFFICE

CERTIFICATE OF CORRECTION

PATENT NO. : 4,057,398

DATED : November 8, 1977

INVENTOR(S) : ROBERT P. BENNETT and IRA KUKIN

It is certified that error appears in the above-identified patent and that said Letters Patent are hereby corrected as shown below:

Claim 8, line 1, delete "7" and insert -- 6 --.

Signed and Sealed this

*First* Day of *May 1979*

[SEAL]

*Attest:*

RUTH C. MASON
*Attesting Officer*

DONALD W. BANNER
*Commissioner of Patents and Trademarks*

Disclaimer and Dedication 4,057,398.—*Robert P. Bennett,* Bridgewater, and *Ira Kukin,* West Orange, N.J. PROCESS FOR REDUCING THE FUSION POINT OF COAL ASH. Patent dated Nov. 8, 1977. Disclaimer and Dedication filed Mar. 10, 1983, by the assignee, *Economics Laboratory, Inc.*

Hereby enters this disclaimer to all claims and dedicates to the Public the entire term of said patent.

[*Official Gazette October 4, 1983.*]